United States Patent [19]

Hagenson

[11] 4,249,437

[45] Feb. 10, 1981

[54] AUTOMATIC MAT CUTTING MACHINE

[76] Inventor: Leo J. Hagenson, P.O. Box 33427, St. Paul, Minn. 55133

[21] Appl. No.: 52,905

[22] Filed: Jun. 28, 1979

[51] Int. Cl.[3] ..... B26D 5/04

[52] U.S. Cl. ..... 83/39; 83/49; 83/364; 83/370; 83/418; 83/423; 83/432; 83/433; 83/425.4

[58] Field of Search ..... 83/368, 404.4, 425.4, 83/432, 433, 919, 404.2, 364, 370, 371, 372, 404, 423, 39, 49

[56] References Cited

U.S. PATENT DOCUMENTS

| | | | |
|---|---|---|---|
| 673,483 | 5/1901 | Shawver | 83/523 |
| 697,997 | 4/1902 | Drinkaus | 83/523 |
| 709,116 | 9/1902 | Shawver | 83/523 |
| 3,156,149 | 11/1964 | Frizelle | 83/433 X |
| 3,640,162 | 2/1972 | Fleming, Jr. et al. | 83/919 X |
| 3,762,250 | 10/1973 | Huskey | 83/368 X |
| 3,774,491 | 11/1973 | Killilea | 83/433 |
| 3,828,638 | 8/1974 | Bonney, Jr. | 83/370 X |
| 3,845,676 | 11/1974 | Pierce | 83/523 |
| 3,935,776 | 2/1976 | Dingus | 83/433 X |
| 4,096,631 | 6/1978 | Ward | 30/294 |
| 4,112,793 | 9/1978 | Pierce | 83/523 X |

*Primary Examiner*—Frank T. Yost

*Attorney, Agent, or Firm*—James V. Lilly

[57] ABSTRACT

A device for automatically and simultaneously making two parallel straight cuts of predetermined length in a mat comprising a transporting means, a pair of cutting means, a single driving means for said cutting means and a pair of signalling means for activating said driving means.

7 Claims, 5 Drawing Figures

AUTOMATIC MAT CUTTING MACHINE

BACKGROUND OF THE INVENTION

The present invention is directed to mat cutting machines and their method of use. More particularly it is directed to automatic mat cutting machines that, preferably, provide bevel cut openings in mats.

Various machines have been designed to provide bevel cut openings in mats. Generally they are not designed to produce professional cut mats in high volume. To the contrary, they typically make one cut in a mat at a time. This necessitates that the mat be repositioned after each cut in order to provide a rectangular opening therein. This is a time consuming operation. Additionally, the cuts made on such machines frequently are wavy, i.e., they do not follow the desired line of the cut exactly. Furthermore, the corners made on these machines are frequently ragged, wavy or overcut. For these reasons there is a great deal of waste in preparing professional quality mats. Consequently, these machines are not useful in providing a high volume of professional appearing cut mats.

These problems are overcome by the device of the present invention. This device is simple, easy to use and is capable of producing a high volume of professional quality mats.

SUMMARY OF THE INVENTION

In accordance with the present invention there is provided a device for automatically and simultaneously making two parallel straight cuts of a predetermined length in a mat. This device comprises:

a transporting means;

a first pair of cutting means above the transporting means for simultaneously making two parallel straight cuts of predetermined length in a mat at a predetermined angle with respect to the surface of the mat;

a first sole driving means for urging the first pair of cutting means into and out of the mat; and a first pair of signalling means for activating the first driving means to urge the first pair of cutting means into and out of the mat.

In operation, the transporting means maintains a mat in a constant position relative thereto and transports the mat in a linear direction. One of the first pair of signalling means is triggered and activates the first driving means to urge the first pair of cutting means into the mat as it is carried beneath the cutting means. This automatically and simultaneously causes two parallel straight cuts of a predetermined length to be made in the mat. When the predetermined length of the cut has been achieved, the other of the first pair of signalling means is triggered thereby activating the first driving means to urge the first pair of cutting means out of the mat.

The device of the present invention provides a number of advantages over previously available mat cutting equipment. For example, it enables the user to simply and accurately prepare mats having sharply defined cut openings therethrough. The openings may have straight sides (i.e., the cutting means may enter the mat perpendicular to the face thereof) or, alternatively they may have bevel sides. The angle of the bevel may be varied from 0° (i.e., a right angle cut) to 60° or more as measured from a line perpendicular to the face of the mat.

The cuts made by the device of the present invention are straight, that is, they do not waiver from the desired line. This is quite unexpected because, bevel cuts above about 30° typically exhibit a great deal of waivering. This is caused by the increased material which the cutting edge encounters during cuts made at such angles.

The device of the present invention provides still other advantages. Thus, the cuts made at the corners are straight (i.e., non wavy) and are not ragged or over cut. Surprisingly, the device of the invention achieves all of these advantages while, at the same time, being automated thereby enabling the user to produce a high volume of mats having a professional appearance.

BRIEF DESCRIPTION OF THE DRAWINGS

The present invention will be described hereinafter with reference to the accompanying drawings wherein like reference characters refer to the same elements throughout the several views and wherein.

DESCRIPTION OF THE PREFERRED EMBODIMENTS

Figure 1:
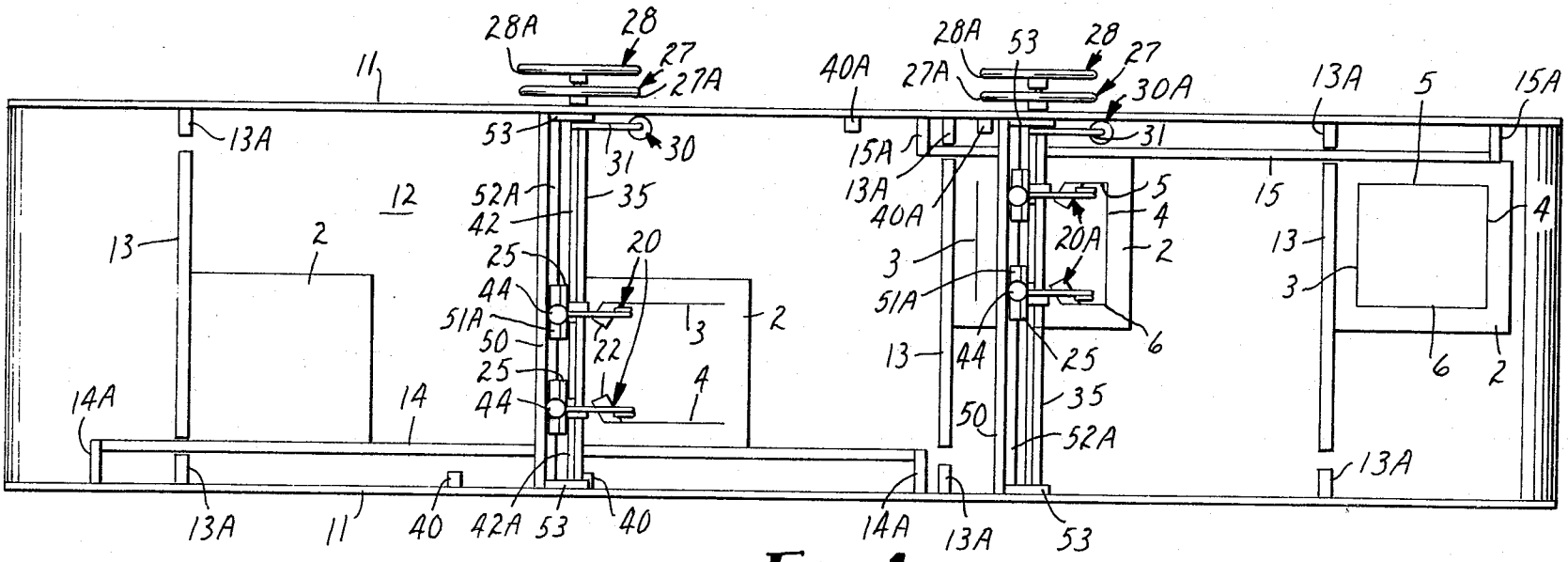
FIG. 1 is a plan view of the device of the present invention.
Figure 2:
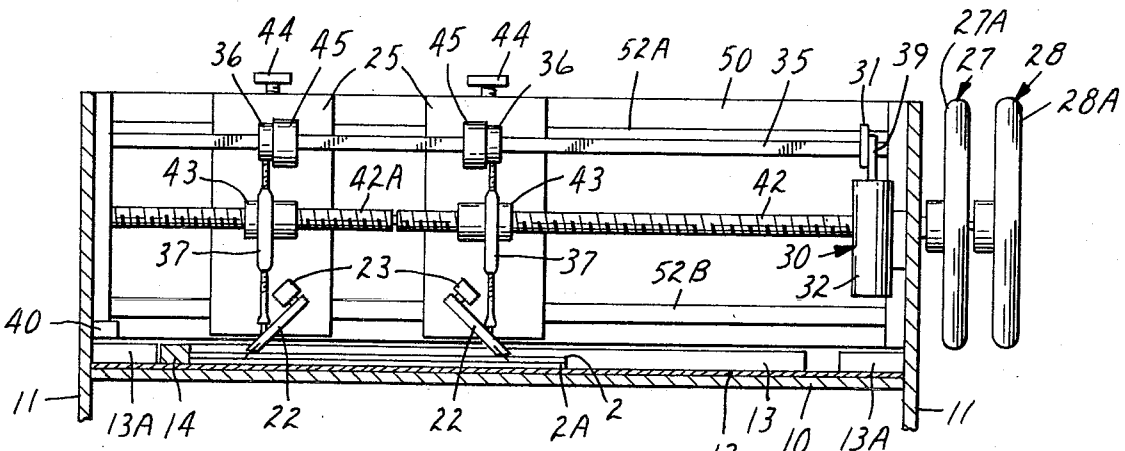
FIG. 2 is a front elevation view showing one pair of the cutting means of the device of FIG. 1.
Figure 3:
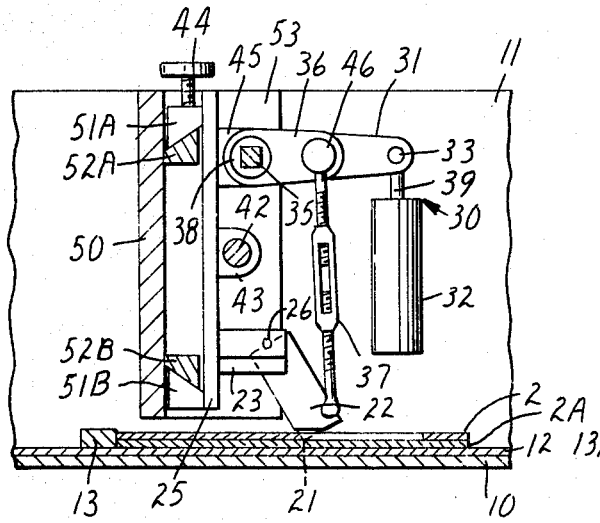
FIG. 3 is a side elevation view showing the cutting means of FIG. 2 in the cutting position.
Figure 4:
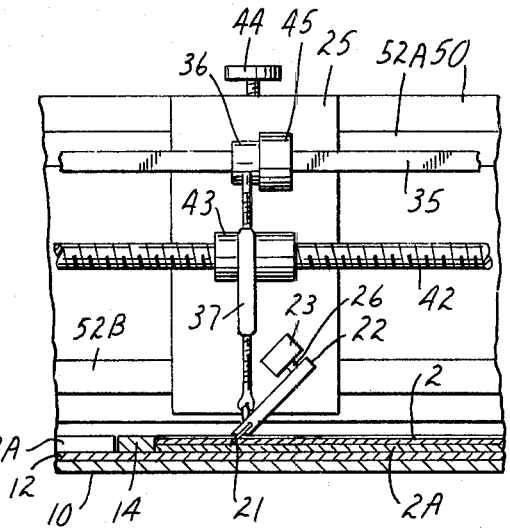
FIG. 4 is a front elevation view of one of the cutting means of FIGS. 2 and 3 in the cutting position.
Figure 5:
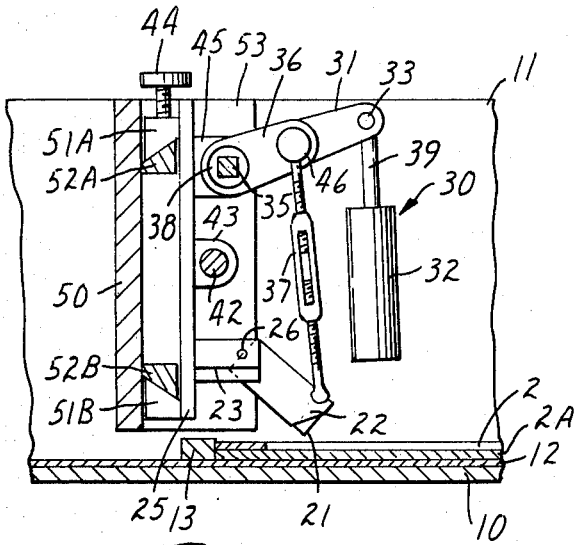
FIG. 5 is a side elevation view of the cutting means of FIGS. 2 and 3 in the raised or non-cutting position.

Referring now to the drawings, FIGS. 1 and 2 show a preferred mat cutting machine of the invention. The machine comprises a base 10 (see FIG. 2), side walls 11, a transporting means 12, a first pair of cutting means 20, a first sole driving means 30, a first pair of signalling means 40, a second pair of cutting means 20A, a second sold driving means 30A, and a second pair of signalling means 40A.

The transporting means 12 lies upon but moves over base 10. It preferably comprises an endless conveyor belt having a first guide bar 13 attached transverse to the longitudinal axis of the belt. The transporting means 12 further preferably has second guide bars 14 and 15 that cooperate with said belt. Guide bars 14 and 15 are situated such that transporting means 12 may pass freely underneath them and guide bars 13 may pass between them. Guide bars 14 and 15 are parallel to the longitudinal axis of the belt. Guide bars 14 and 15 are situated on opposite sides of transporting means 10 for reasons that will be described more fully hereinafter. They are attached to side walls 11 by means of support arms 14A and 15A respectively.

Guide bars 13A are also provided between side walls 11 and guide bars 14 and 15. Guide bars 13A are attached to transporting means 12 parallel to and in line with guide bars 13. They pass beneath support arms 14A and 15A and trigger the signalling means.

The first and second pairs of cutting means 20 and 20A, the first and second driving means 30 and 30A, and the first and second pairs of signalling means 40 and 40A are respectively identical to each other and, are described in more detail with reference particularly to FIGS. 2 through 5.

Cutting means 20 comprise a pair of cutting implements 21 held in holders 22. Holders 22 are held at the desired angle of the bevel cut by means of block 23 and are free to pivot on blocks 23 around pins 26. Block 23 is attached to plate 25. Plate 25 is slideably mounted on support 50 by rails 51A, 51B, 52A and 52B. Support 50 is securely affixed to side supports 53 which are in turn securely attached to the side walls 11 of the machine.

The distance between each of the cutting implements 21 in a given pair of cutting means 20 may be changed by adjusting means 27 and 28. Adjusting means 27 comprises a wheel 27A attached to a hollow threaded rod 42. Adjusting means 28 comprises a wheel 28A attached to a threaded rod 42. Threaded rod 42A passes through hollow rod 42.

Each of the adjusting means communicates with a threaded block 43 attached to plate 25. Locking screws 44 are provided to fix the distance between the cutting means 20 once changed by means of adjusting means 27 and 28.

When it is desired to change the distance between each of the pair of cutting means 20, wheels 27A and 28A are rotated thus causing rods 42 and 42A to rotate in threaded blocks 43 and move plates 25 on rails 52A and B. When the distance between each of the cutting means 20 is equal to the distance desired between the straight cuts to be made, locking screws 44 are turned down to secure the plates 25 at the desired point.

The driving means 30 and 30A preferably comprise air cylinders 32 hingeably connected to square rod 35 by lever 31. Lever 31 is hingeably connected on one end to the air cylinder 32 by rod 39 at pin 33.

Square shaft 35 passes through a square opening in lever 31 near the other end of said lever. This other end of lever 31 is attached to a support bearing (not shown) which is fixedly attached to plate 25. Square shaft 35 enters this support bearing and pivots therein.

Square shaft 35 is also attached to each pair of cutting means 20. Thus square shaft 35 passes through a square opening provided in lever arm 36. This lever arm is rotatably attached to a support bearing 45 which is in turn fixed to plate 25. Square shaft 35 also passes through support bearing 45 but does so such that it pivots around bearing 38.

Lever arm 36 is attached to holders 22 of the cutting means 20 by attaching means 37. The attaching means 37 preferably comprise a turnbuckle. This allows easy removal of the cutting means when necessary. Preferably each of the attaching means are attached to the holders 22 by a universal joint that allows the holders to move freely when the cutting means are raised from or lowered into the mat. It is further preferred that the attaching means 37 be attached to lever 36 such that it can rotate on shaft 46 as the cutting means are raised and lowered.

Square shaft 35 cooperates with the driving means and the cutting means such that when lever 31 moves upward relative to the air cylinder 32, the square shaft rotates in a counter-clockwise direction and when lever 31 moves downward relative to the air cylinder 32, the square shaft rotates in a clockwise direction. The former movement urges the cutting implements 21 out of the mat while the latter rotation urges the cutting implements 21 into the mat.

The signalling means 40, and 40A trigger the first and second driving means respectively. As noted, each of the signalling means comprise a pair of elements. The first of each pair of signalling elements signals each of the sole driving means to urge the cutting means into the mat. The second of each pair of signalling elements signals the driving means to urge the cutting means out of the mat.

Preferably the signalling means are moveably mounted on walls 11 respectively so that the exact length of the cut to be made in the mat may be adjusted to fit the particular opening desired in the mat. A variety of signalling means are useful in the invention. For example, air switches have been found particularly useful.

In the most preferred embodiment of the present invention two separate pairs of cutting means are provided with the second being situated downstream from the first. Additionally there is also provided a turning means between the two pairs of cutting means. The turning means rotates the mat 90° on the transporting means after the first set of parallel cuts has been made. Additionally, it relocates the mat from the corner formed by guide bars 13 and 14 to the corner formed by guide bars 13 and 15. This enables the machine to be fully automated during the cutting processes.

A variety of techniques are useful in turning the mat. However, it has been found that suction is particularly useful in effecting the turn because it can be conveniently employed to lift the mats. Once the mats have been suitably repositioned, the suction can be replaced by a short burst of air to drop the mats onto the belt.

As has been noted, the angle of the bevel cut made may be adjusted to suit the particular users needs. This may be accomplished by varying the angle of block 23. The most common bevel angles are 30°, 45°, and 60°.

The operation of the machine of the invention is readily understood. Thus, referring to FIG. 1, a mat 2 is abutted against guide bars 13 and 14. Preferably a sacrificial mat 2A (See FIGS. 2, 3, 4 and 5) is placed beneath mat 2 so that during cutting the cutting implements 21 do not cut the surface of transporting means 12. The transporting means 12 continually moves the mat in a linear direction thereby triggering the events that result in cutting the mat. Thus, transporting means 12 carries the mat 2 through the first cutting means 20. In so doing guide bar 13A triggers the first of the pair of signalling means 40 to cause driving means 30 to urge the cutting means 20 into mat 2. The cutting means then simultaneously make two parallel cuts 3 and 4 in mat 2. When the predetermined length of the cuts has been achieved, guide bar 13A triggers the second of the pair of signalling means 40 to cause driving means 30 to urge cutting means 20 out of mat 2.

The mat 2 is then repositioned against guide bars 13 and 15, preferably automatically, as previously described. The transporting means 12 then carries the cut mat through the second pair of cutting means 20A causing a series of events identical to that just described. Thus, parallel cuts 5 and 6 are provided in the mat. The cuts 3, 4, 5 and 6 are straight and the corners of the cuts are not ragged or overcut. Thus, the cuts 5 and 6 begin and end exactly with cuts 2 and 3. The result is a mat having a rectangular opening provided therein.

Other appurtenances may be added to the device of the invention. They do not lie at the heart of the invention and are, therefor, not described in great detail herein. Some appurtenances which may be added include means for automatically placing mats to be cut on the transporting means and means for automatically removing the mats from the transporting means after they have been cut.

Still other variations will be apparent to those skilled in the art. These other variations are included within the scope of the foregoing disclosure and the following claims.

What is claimed is:

1. A device for automatically and simultaneously making two parallel straight cuts of a predetermined length in a mat, said device comprising:

a transporting means;

a first pair of cutting means above said transporting means for simultaneously making two parallel straight cuts of predetermined length in a mat at a predetermined angle with respect to the surface of said mat;

a first single driving means for urging said first pair of cutting means into and out of said mat; and a first pair of signalling means for activating said first driving means to urge said first pair of cutting means into and out of said mat;

wherein said transporting means maintains said mat in a constant position relative thereto and transports said mat in a linear direction; and wherein one of said first pair of signalling means activates said first driving means to urge said first pair of cutting means into said mat while said mat is transported by said transporting means thereby automatically and simultaneously making two parallel straight cuts of a predetermined length in said mat; and wherein the other of said first pair of signalling means activates said first driving means to urge said first pair of cutting means out of said mat after said cuts have been made.

2. A device according to claim 1 wherein said transporting means comprises a continuous conveyor belt having a first guide bar attached to said belt transverse to the longitudinal axis of said belt and a second guide bar perpendicular to said first guide bar and parallel to the longitudinal axis of said belt.

3. A device according to claim 2 further comprising a second pair of cutting means above said transporting means for simultaneously making two straight cuts of predetermined length in said mat at a predetermined angle with respect to the surface of said mat;

a second single driving means for urging said second pair of cutting means into and out of said mat; and a second pair of signalling means for activating said second driving means to urge said second set of cutting means into and out of said mat;

wherein one of said second pair of signalling means activates said second driving means to urge said second pair of cutting means into said mat while said mat is transported by said transporting means thereby making two additional parallel straight cuts of predetermined length in said mat; and wherein the other of said second pair of signalling means activates said second driving means to urge said second pair of cutting means out of said mat after said additional cuts have been made.

4. A device according to claim 3 wherein said cutting means are oriented such that they provide a bevel cut in said mat.

5. A device according to claim 4 wherein the angle of said bevel is 45°.

6. A device according to claim 5 further comprising adjusting means for adjusting the distance between each of the cutting means of said first and second pair of cutting means.

7. A method for making two simultaneous parallel straight cuts of predetermined length in a mat comprising the sequential steps of conveying a mat along a path by a transporting means;

triggering a first pair of signalling means to activate and urge a first pair of cutting means into said mat;

making, at one time, two parallel straight cuts of a predetermined length in said mat;

triggering a second pair of signalling means to activate and urge said first pair of cutting means out of said mat.

* * * * *